US005497822A

United States Patent [19]

Schenk

[11] Patent Number: 5,497,822

[45] Date of Patent: Mar. 12, 1996

[54] SHOE FOR USE ON CONTINUOUS CASTING MACHINES AND METHOD OF USE

[76] Inventor: Raymond L. Schenk, 270 Hemlock La., Marysville, Mich. 48040

[21] Appl. No.: 277,919

[22] Filed: Jul. 20, 1994

[51] Int. Cl.[6] ..... B22D 11/06

[52] U.S. Cl. ..... 114/479; 164/429

[58] Field of Search ..... 164/479, 429, 164/492, 493, 250.1, 505, 507, 337, 133, 135, 488, 437, 439

[56] References Cited

U.S. PATENT DOCUMENTS

| | | | |
|---|---|---|---|
| 4,122,890 | 10/1978 | Atkins et al. . | |
| 4,349,067 | 9/1982 | Wirtz et al. | 164/429 |
| 4,545,422 | 10/1985 | McLane et al. | 164/429 |
| 5,388,633 | 2/1995 | Mercer, II et al. | 164/337 |

FOREIGN PATENT DOCUMENTS

| | | | |
|---|---|---|---|
| 934522 | 10/1973 | Canada . | |
| 0467015A2 | 1/1992 | European Pat. Off. . | |
| 0485996A2 | 5/1992 | European Pat. Off. . | |
| 4-33748 | 2/1992 | Japan | 164/337 |

*Primary Examiner*—P. Austin Bradley
*Assistant Examiner*—I.-H. Lin
*Attorney, Agent, or Firm*—Harness, Dickey & Pierce

[57] ABSTRACT

A continuous casting machine is disclosed of the type having a rotary mold cavity movable relative to a shoe in fluid communication with a source of molten casting material. The shoe has a main body defining an internal passageway and a discharge slot leading from the internal passageway to an outer surface of the shoe. The shoe also has an inlet and an outlet connecting the internal passage to the source of molten casting material. A heating mechanism is positioned within the internal passageway and is controlled for heating the molten casting material flowing through the passageway prior to its discharge from the discharge slot.

26 Claims, 8 Drawing Sheets

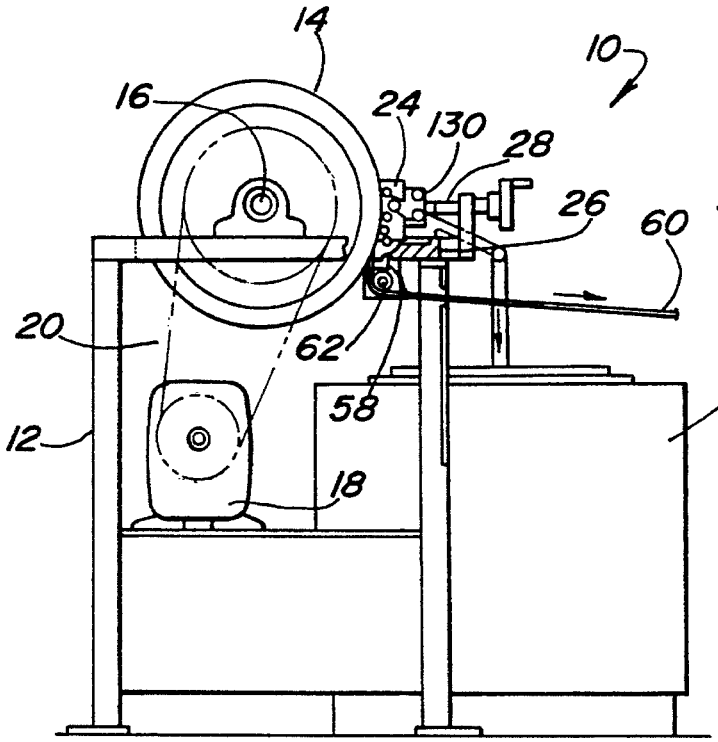
Fig-1
Fig-2
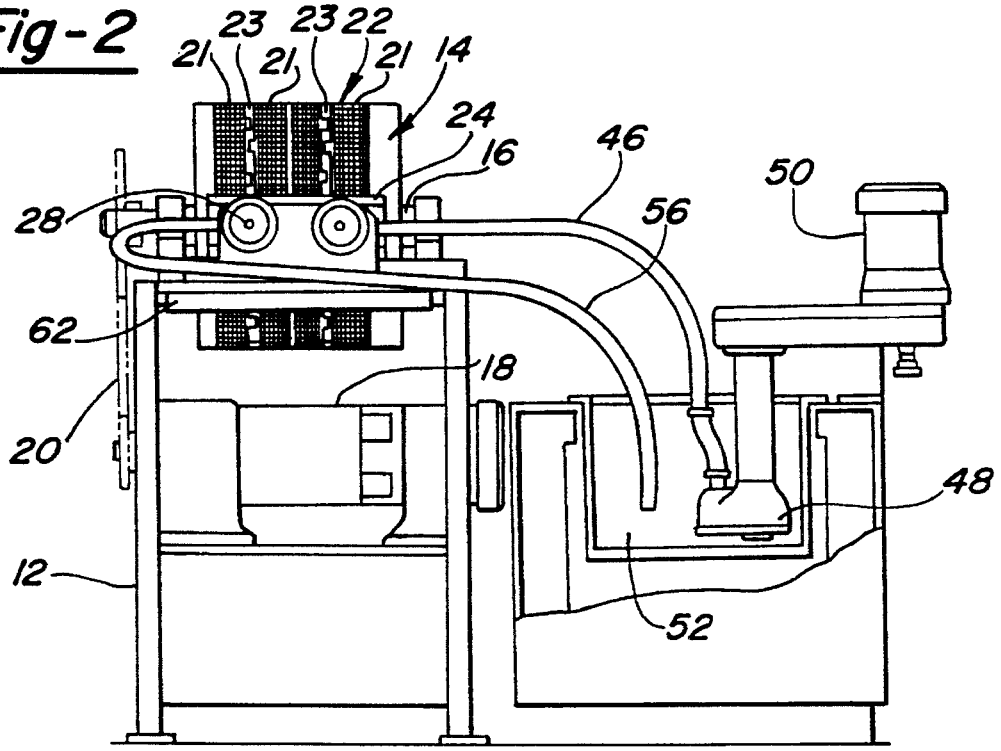

SHOE FOR USE ON CONTINUOUS CASTING MACHINES AND METHOD OF USE

FIELD OF THE INVENTION

The present invention relates generally to a method and apparatus for casting battery grids of the type used in lead-acid batteries and, more particularly, to an improved shoe for use on continuous casting machines which is equipped with a supplemental heating mechanism for maintaining the casting temperature of the molten lead flowing through the shoe.

BACKGROUND

Lead-acid batteries are a well known source of energy used in a variety of applications including, for example, automotive starting. The central structural elements of conventional lead-acid batteries are positive and negative grids coated with an active material to form plates, each plate having a lug and being separated from adjacent plates within a battery by porous separators. The grids serve as framework and electrical contact between the positive and negative active materials which generally serve to conduct current. This conjoint electrochemical (corrosion) action and structural (load-bearing) role cause stress to the grids, particularly the positive grids. Failure of the battery occurs when the grids are no longer able to provide adequate structural support or current flow. Therefore, the primary properties of interest in grid formation and design are strength and resistance to both corrosive and mechanical stresses. Other properties to consider include castability, compatibility with the active material (adherence), and various electrochemical and metallurgic effects. With respect to the latter properties, fluidity and resistance to "hot-tearing" (shrinkage tearing) upon solidification and grain formation are of primary importance.

Modernly, a large percentage of the battery grids used in commercially-available lead-acid batteries are manufactured by a process generically referred to as "continuous casting" (con-cast). Traditionally, continuous casting machines include a rotary drum having a reticulated grid pattern (i.e., mold cavity) machined into its outer peripheral surface, and a stationary shoe which overlays the grid pattern. The shoe functions both to dispense the molten lead into the patterned mold cavity and to scrape off any excess molten lead upon rotation of the drum. Due to rapid solidification of the molten lead, a continuous grid strip is removed from the drum upon rotation past the shoe. One example of a conventional continuous casting machine and the lead con-cast process associated therewith is disclosed in U.S. Pat. No. 4,349,067 issued to Wirtz et al.

Unfortunately, conventional continuous casting machines suffer from several drawbacks which significantly limit their production capabilities. First, due to the rapid solidification characteristics of molten lead, large temperature gradients can occur in the molten lead flowing through the shoe and, in turn, as it is delivered across the width of the patterned mold cavity. To avoid such undesirable temperature gradients, the width of the shoe has to be relatively narrow which limits the width of the grid strip, thereby impacting the productivity (i.e., grids/min.) of the continuous casting machine. In addition, conventional con-cast processing has difficulty in consistently forming battery grids, particularly positive battery grids, with the desired mechanical strength and resistance to mechanical and corrosive stresses. In particularly, the current con-cast process is considered impractical to form positive battery grids because of the variable metallurgic effects resulting in improper grain formation which lead to increased corrosion and mechanical stress on the grid. Positive grids differ from negative grids basically in that positive grids require greater strength due to anodic attack, and thus are generally formed with an increased cross-sectional thickness in comparison to negative grids. However, increased mold depth is not conducive to con-cast processing because grain formation is disrupted due to the gradient cooling and flow turbulence caused during discharge of the molten lead. As known, poor grain formation leads to increased corrosion, decreased strength, disruption of the reticulum and, eventually battery failure. Thus, recognized deficiencies exist in the field of con-cast processing of lead battery grids which, to this point, have not been adequately addressed.

SUMMARY OF THE INVENTION

Accordingly, the present invention is directed to overcoming these deficiencies and shortcomings by providing an improved shoe for use on a continuous casting machine that is equipped with supplemental heaters positioned in direct communication with the molten casting material flowing through the shoe for maintaining the molten material at a predetermined casting temperature. As such, gradient cooling of the molten casting material is prevented which results in cast products having improved grain structure, increased strength and resistance to corrosive and mechanical stresses.

As a related object, the supplemental heaters permit the use of wider shoes and corresponding mold cavities for casting a wider continuous battery grid strip. The wider battery grid strip can define adjacent sets of identical or different grids, thereby significantly increasing the output rate of the continuous casting machine. Alternatively, the wider battery grid strip can define a larger battery grid for use in commercial (i.e., fork truck) battery applications.

Another object of the present invention relates to an improved method for casting positive battery grids on a continuous casting machine equipped with the improved novel shoe construction.

In each preferred embodiment, the shoe includes: an internal passageway; an inlet passage for delivering molten casting material to the internal passage from a source of molten material; an outlet for returning the molten material from the internal passageway to the source; an elongated discharge slot providing a flow pathway between the internal passage and an outer peripheral surface of the shoe; and a heating mechanism disposed in the internal passageway for uniformly maintaining the temperature of the molten material flowing within the internal passageway. Thus, the molten material can be delivered at a uniform temperature through the discharge slot to a patterned mold cavity of any desired width that is machined into a continuously moving mold component.

In one particular embodiment, the shoe of the present invention includes a distribution tube that is positioned within the internal passageway and surrounds the heating mechanism. The distribution tube has a series of injector holes formed therein that are alignable with the discharge slot in the shoe. The distribution tube is rotatably supported within the shoe such that it is rotatable within the internal passageway. A connecting aperture is formed in the distribution tube that is aligned with the inlet passage in the shoe for allowing delivery of the molten casting material into the elongated chamber defined between the heating mechanism and the distribution tube regardless of the rotated position of the distribution tube. Thus, the alignment between the injector holes and the discharge slot can be selectively adjusted by rotating the distribution tube. Such adjustability provides a means for minimizing turbulence of the molten casting material flowing through the discharge slot and onto the continuously moving mold cavity. Additionally, a portion of the distribution tube can be deformed (i.e., dimpled or flattened) to define an enlarged entrapment chamber adjacent to the discharge slot to permit accumulation of excess molten material therein prior to its return to the heated bath through the outlet passage.

In an alternative embodiment, the distribution tube may be formed in two sections that can be individually adjusted to vary injection conditions across the length of the slot.

In yet another embodiment, the shoe is a modular assembly comprised of a series of interconnectable shoe sections.

Still another embodiment is directed to the addition of a rotary impeller within an internal passageway of the shoe for controllably regulating the flow of molten lead through the discharge slot.

As will be appreciated, the present invention can include various combinations of the above-described embodiments. Furthermore, methods of use for each of the preferred embodiments described above are provided for by the present invention. It is understood that other materials besides lead can be dispensed through the shoe of the present invention. It is also appreciated that other products besides battery grids can be formed.

Additional objects, advantages, and features of the present invention will become apparent from the following description and appended claims, taken in conjunction with the accompanying drawings.

BRIEF DESCRIPTION OF THE DRAWINGS

FIG. 1 is a side elevational view of an otherwise conventional continuous casting machine equipped with the improved shoe of the present invention;

FIG. 2 is an end view of the machine shown in FIG. 1;

DETAILED DESCRIPTION OF THE PREFERRED EMBODIMENTS

Figure 3:
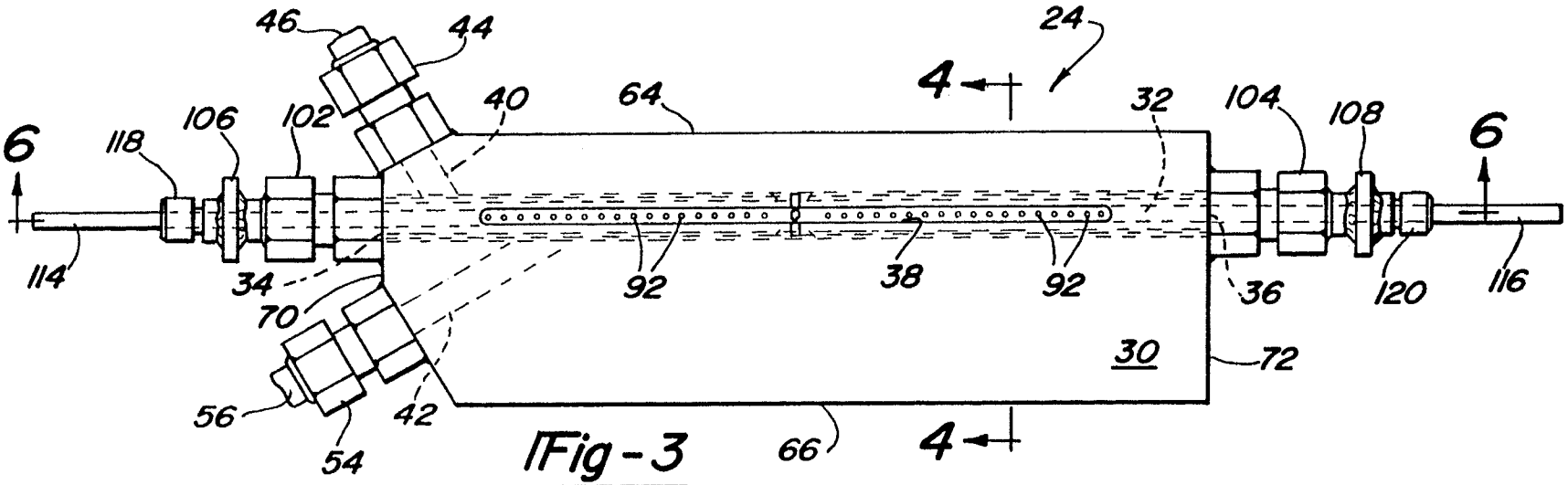
FIG. 3 is a side view of the shoe used on the continuous casting machine shown in FIGS. 1 and 2, and which is constructed according to a first preferred embodiment of the present invention.

In general, the present invention is directed to an improved shoe for use with a continuous casting machine. The shoe is an improved version of otherwise conventional shoes used on continuous casting machines for the purpose of distributing and injecting a molten media, such as molten lead, into a continuous mold cavity. More particularly, the improved shoe is equipped with a heating mechanism that is in direct communication with the molten material flowing through the shoe for maintaining the molten material at a uniform casting temperature. Such a provision for supplementally heating the molten casting material promotes improved grain structure upon re-solidification thereof. While the improved shoe of the present invention is shown in association with a particular continuous casting machine, it will be appreciated that the machine shown is merely exemplary of but one type to which the novel features of the present invention are applicable.

Referring to FIGS. 1 and 2, an apparatus, hereinafter referred to as continuous casting machine 10, is shown to include a frame 12 on which a casting drum 14 is journalled on shaft 16 for rotation about a horizontal axis. Casting drum 14 is rotated at a desired speed by a motor 18 and drive chain 20 arrangement. In addition, a mold cavity 22 is machined into the outer peripheral surface of casting drum 14. In the particular embodiment shown, mold cavity 22 includes three grid patterns 21 separated by lug strips 23. A shoe 24 is suitably mounted to a slide base 26 and is urged against the periphery of casting drum 14 with a desired pressure by means of adjustable clamp 28. As is conventional, shoe 24 is generally a block of metal having an outer surface 30 which conforms closely to, and which is in sliding engagement with, a short arcuate segment of casting drum 14. As will be appreciated, shoe surface 30 can be of any profile which facilitates smooth sliding movement of a cavity mold relative thereto.

Shoe 24 includes an elongated internal cylindrical passageway 32 having first and second open ends 34 and 36, respectively, A slot 38 extends between passageway 32 and outer shoe surface 30. Shoe 24 also includes an inlet passage 40 and an outlet passage 42 both of which communicate with cylindrical passageway 32. Inlet passage 40 is coupled via a suitable coupling 44 and supply line 46 to the outlet of a pump 48 that is driven by a variable-speed motor 50. Pump 48 is maintained below the liquid level of the molten casting material within a heated pot 52. Similarly, the outlet passage 42 of shoe 24 is coupled via a suitable coupling 54 to a return line 56 extending into heated pot 52. Variable-speed motor 50 is controlled for causing pump 48 to supply molten casting material to internal passageway 32 at a predefined pressure and flow rate. A water spray pipe 58 is positioned directly below shoe 24 to assist in the rapid solidification of the casting material into a continuous grid strip 60 discharged on the downstream side of shoe 24. Grid strip 60 is stripped from grid cavity 22 and directed around an elongated roller 62.

Figure 4:
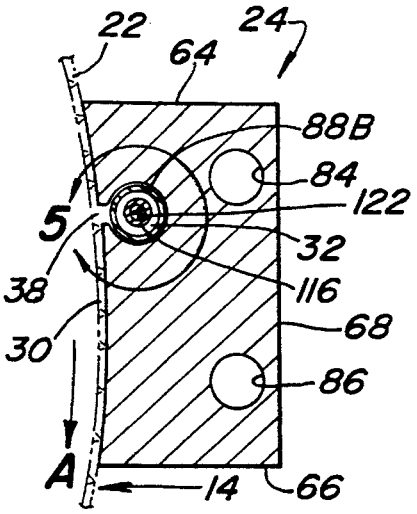
FIG. 4 is a sectional view taken along line 4—4 in FIG. 3.
Figure 5:
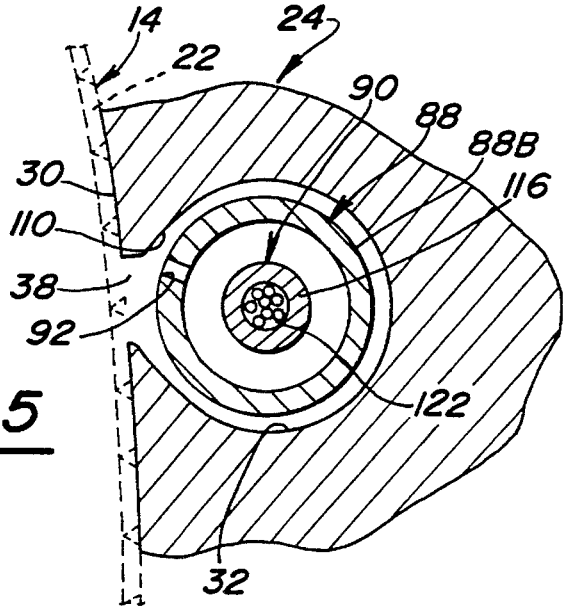
FIG. 5 is an enlarged view of a portion of the shoe shown in FIG. 4.

With particular reference now to FIGS. 3 through 6, a first preferred embodiment of shoe 24 is shown with greater specificity. In addition to arcuate surface 30, shoe 24 also includes a top surface 64, a bottom surface 66, a back surface 68, and a pair of end surfaces 70 and 72. The first open end 34 of internal passageway 32 extends through end surface 70 of shoe 24 while its second open end 36 extends through end surface 72. FIG. 4 shows heater holes 84 and 86 in which suitable rod-type heaters (not shown) are installed for providing start up heat and warpage control. Warpage can be caused by having a substantially elevated temperature in the portion of shoe 24 surrounding passageway 32 due to the initial flow of molten casting material. Moreover, rotary casting drum 14 is shown in phantom rotating past shoe 24 in the direction of arrow "A" and which has grid cavity 22 formed on its outer peripheral surface. The width of grid cavity 22 is equal to or slightly less than that of discharge slot 38.

Figure 6:
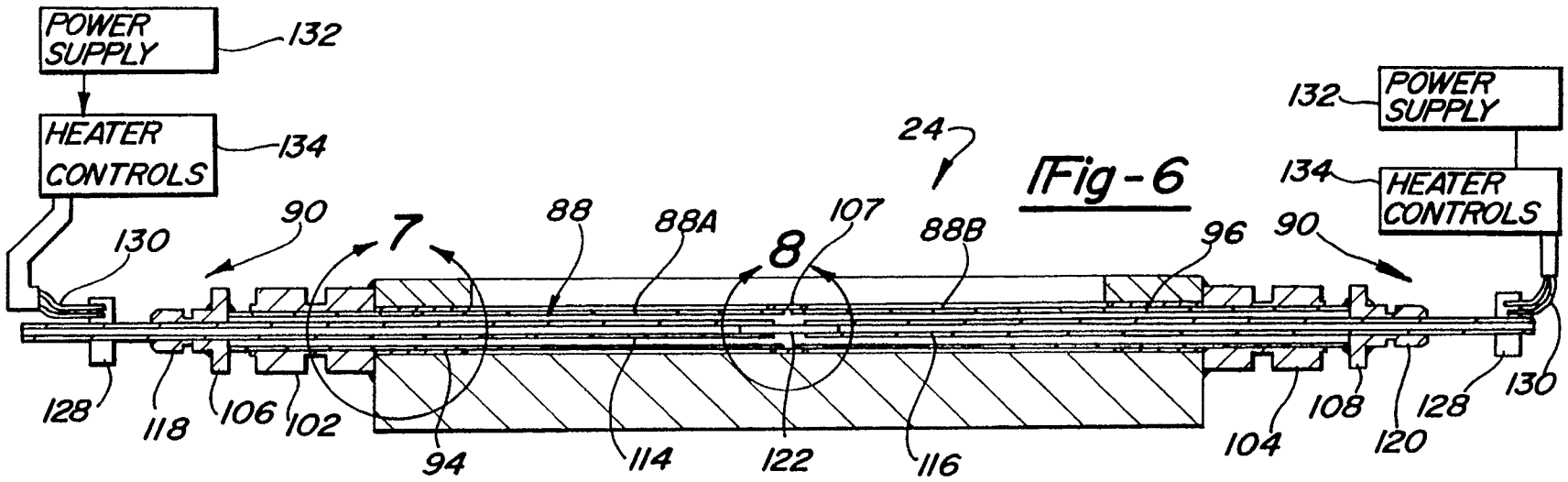
FIG. 6 is a sectional view generally taken along line 6—6 in FIG. 3.
Figure 7:
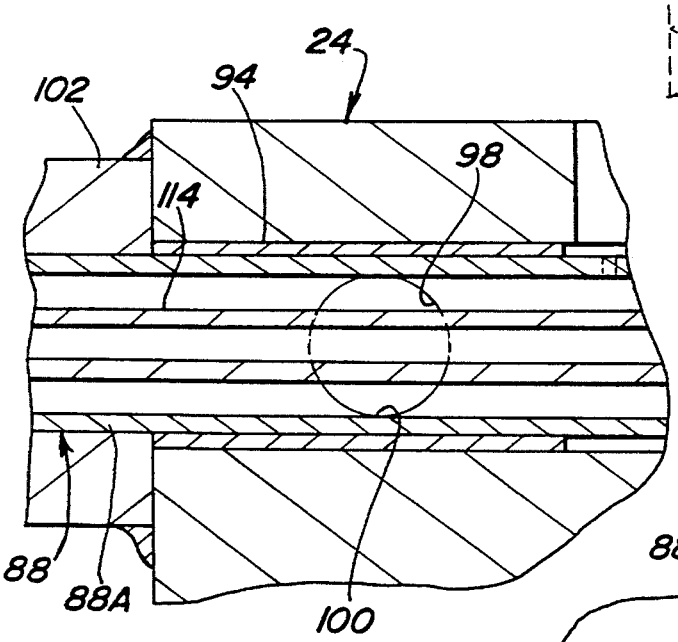
FIG. 7 is an enlarged view of a portion of the shoe shown in FIG. 6.

In accordance with the present invention, an elongated distribution tube 88 is shown disposed within internal passageway 32 and which surrounds an electrically-controlled heating mechanism 90. Distribution tube 88 has a series of orifices, referred to as injector holes 92, which extend across a length of distribution tube 88 corresponding generally to the length of discharge slot 38. FIG. 6 shows distribution tube 88 journally supported in internal passageway 32 of shoe 24 via first and second sealing sleeves 94 and 96, respectively. To this end, FIG. 7 is an enlarged partial view of FIG. 6 showing first sealing sleeve 94 in greater detail. First sealing sleeve 94 prevents molten casting material from passing directly from inlet passage 40 to outlet passage 42. To permit the desired communication between inlet passage 40 and internal passageway 32, distribution tube 88 has a connecting hole 98 aligned with a connecting orifice 100 formed in first sealing sleeve 94 which, in turn, is aligned with inlet passage 40. Thus, in use, molten casting material is dispensed into shoe 24 from the heated material source (i.e., pot 52) through inlet passage 40 to internal passageway 32 and out onto grid cavity 22 on casting drum 14 through discharge slot 38. While distribution tube 88 may be a unitary tubular component, it is preferably disclosed as comprised on two separate tube segments 88A and 88B extending into internal passageway 32 from its opposite open ends 34 and 36, respectively. In addition, end fittings 102 and 104 are coupled to ends 70 and 72, respectively, of shoe 24 and journally support portions of distribution tube segments 88A and 88B, respectively, for sealing the outer ends of internal passageway 32. In addition, the terminal ends of tube segments 88A and 88B are sealed by hex nut segments 106 and 108, respectively, while the facing end portions of tube segments 88A and 88B are journally supported in internal passageway 32 via a central sealing sleeve 107.

Figure 8:
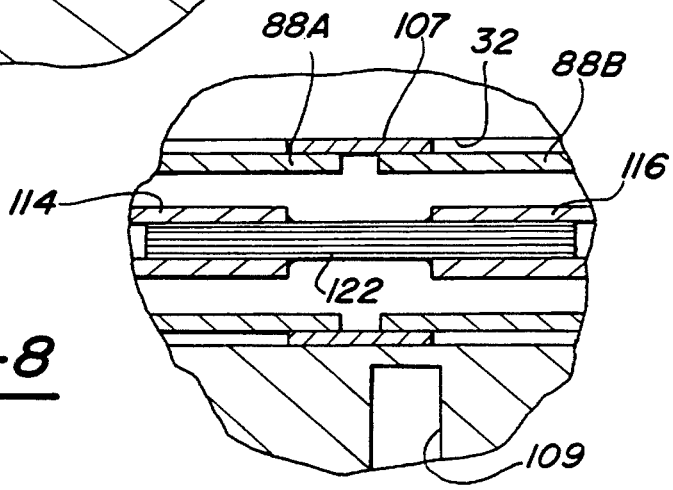
FIG. 8 is an enlarged view of another portion of the shoe shown in FIG. 6.

As best seen from FIG. 8, a bore 109 is formed in shoe 24 that terminates in close proximity to internal passageway 32 and in which a suitable thermocouple device can be inserted for measuring the temperature of the molten casting material and provide feedback data for automatic control of heating mechanism 90. Thus, the alignment of injector holes 92 relative to discharge slot 38 can be adjusted by rotating hex nuts 106 and 108. Such rotation of tube segments 88A and 88B changes the angle at which the molten casting material is introduced into internal passageway 32 and effects the final deposition of molten material onto grid cavity 22. For example, to avoid turbulence at discharge slot 38, injector holes 92 are rotated upwardly toward top surface 64 (i.e., upstream) of shoe 24 such that the molten casting material will initially hit an inner forward roof 110 (FIG. 5), thereby flaring the stream of molten material before it is discharged through slot 38 and contacts moving mold cavity 22. To allow adjustable rotation of the distribution tubes 88A and 88B, connecting hole 98 and connecting orifice 100 are larger than inlet passage 40.

According to the present invention, electrically-controlled heating mechanism 90 can be any of a variety of devices. For example, as best shown in FIGS. 6 and 8, heating mechanism 90 includes a pair of resistance heater tubes 114 and 116 sized to carry heavy electrical current and which respectively extend from opposite sides of shoe 24 toward the center of the internal passageway 32. Heater tube 114 is sealed with first heater fitting 118 and heater tube 116 is sealed with a second heater fitting 120. To facilitate rotation of distribution tube 88, a stranded wire 122 extends between facing ends of heater tubes 114 and 116. An appropriately sized clamp 128 and cables 130 are attached to heat tubes 114 and 116 for electrically connecting each heater tube to a remote power supply 132 and heater controls 134. Heater tubes 114 and 116 may be controlled by a common power supply 132 and heater controls 134 or individually if so desired. In operation, a predetermined electrical current is applied to heater tubes 114 and 116 before the flow of molten material is started. This initial heating of shoe 24 is desirable for approximating the material's melting temperature based on its total resistance. When lead pump 48 is activated, the resistance will change due to the flowing molten material and, therefore, the power value is automatically increased for maintaining a uniform molten temperature. As noted, thermocouples are used for providing temperature data to electronic heater controls 134. In response, heater controls 134 automatically regulate the power supplied by power source 132 to heating mechanism 90 so as to regulate the temperature of heater tubes 114 and 116 for maintaining the molten material temperature along the entire width of shoe 24. In this manner, gradient cooling of molten material flowing within shoe 24 is eliminated, thereby overcoming a significant drawback that heretobefore has limited application of continuous casting processing. As noted, each heater tube 114 and 116 may be separately controlled or simultaneously controlled pursuant to the particular material heating characteristics and the-dictating operating parameters.

Figure 9:
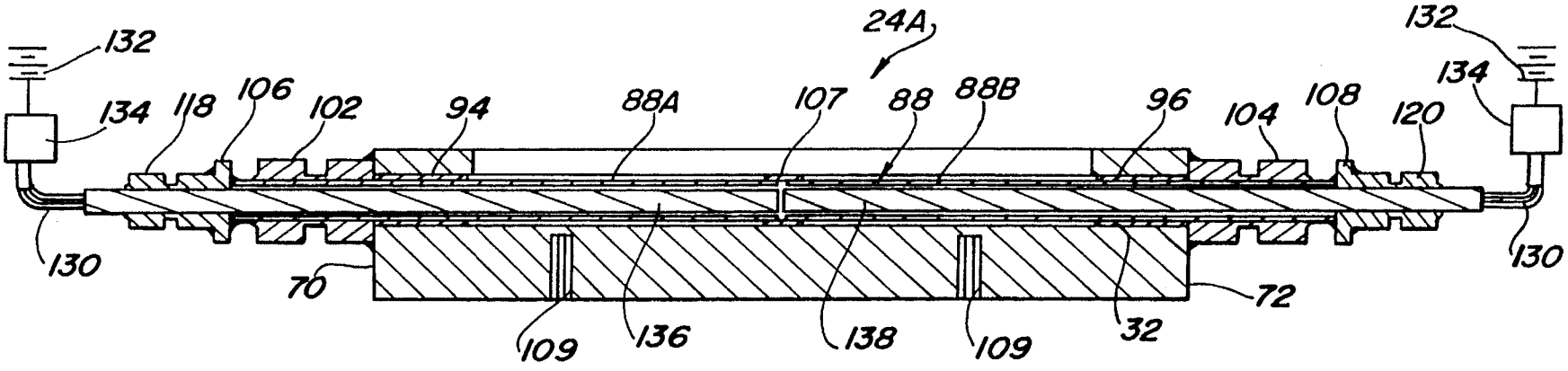
FIG. 9 is a sectional view of an alternative embodiment of the shoe according to the present invention.
Figure 10:
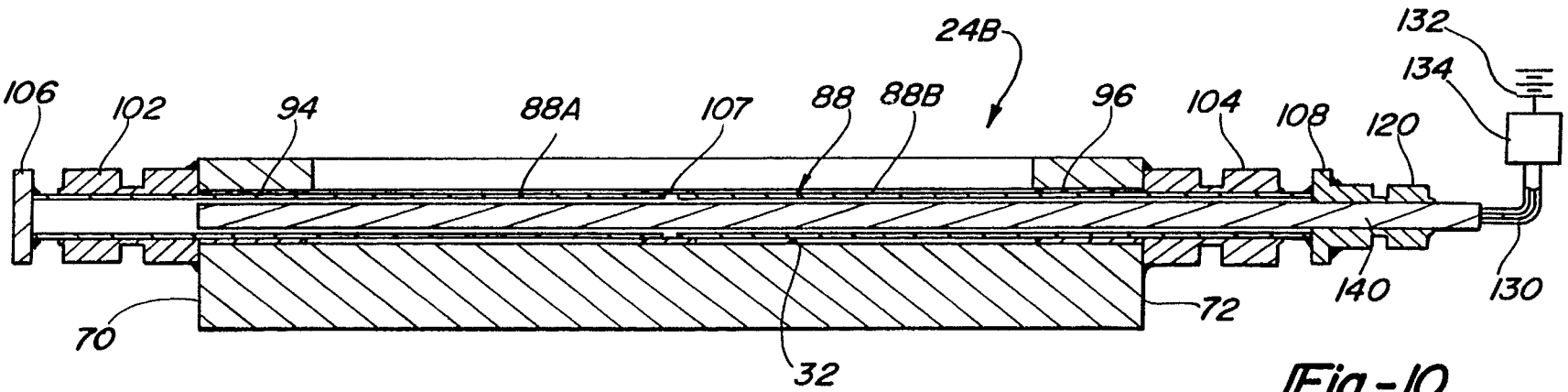
FIG. 10 is a sectional view of another alternative embodiment of the shoe according to the present invention.

With particular reference to FIG. 9, a longitudinal cross-sectional view of an alternative preferred embodiment of the shoe of the present invention is shown which is indicated generally by the reference designation 24A. Due to the commonality of components, like numbers are used to describe components that are similar in structure and function to those previously described in reference to shoe 24. In this embodiment, heating mechanism 90 includes a pair of cartridge heaters 136 and 138. Extending from cartridge heaters 136 and 138 are leads 130 each connected to power supply 132 and temperature control 134. Moreover, FIG. 10 also illustrates a longitudinal cross-sectional view of an alternative preferred embodiment of the shoe of the present invention, indicated generally by the reference numeral 24B.

In this, embodiment, heating mechanism 90 is a single cartridge heater 140 extending across the entire length of shoe 24B. As such, hex nut 106 is configured as an end plate for enclosing the outer end of distribution tube segment 88A.

Figure 11:
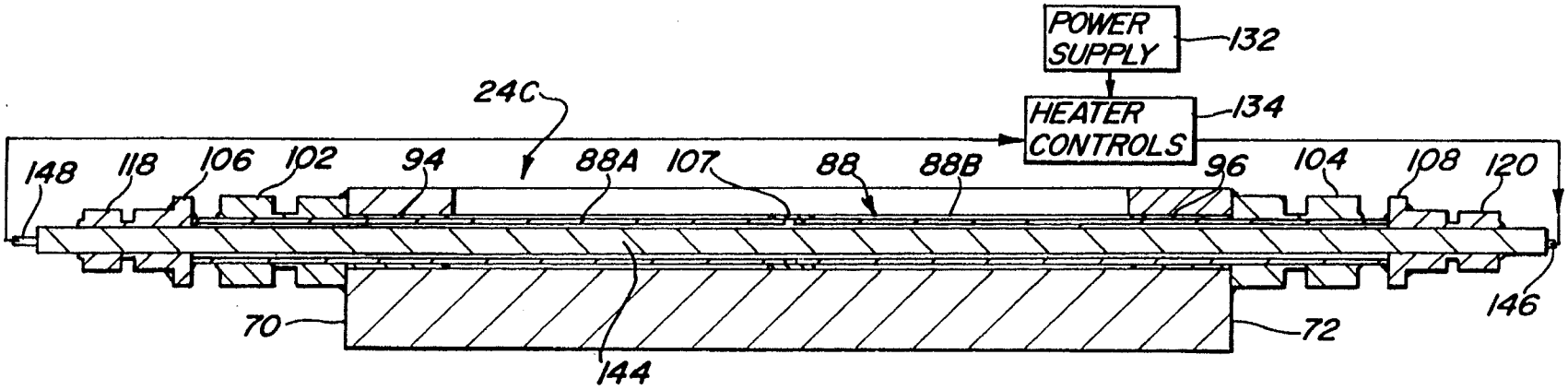
FIG. 11 is a sectional view of yet another alternative embodiment of the shoe according to the present invention.

FIG. 11 illustrates a longitudinally extending cross-sectional view of an alternative preferred embodiment of the shoe of the present invention, indicated generally by the reference designation 24C. In this embodiment, heating mechanism 90 is a heater rod 144 having leads 146 and 148 attached at opposite ends. Also, commercially-available triangular-shaped heater rods can also be used.

Figure 12:
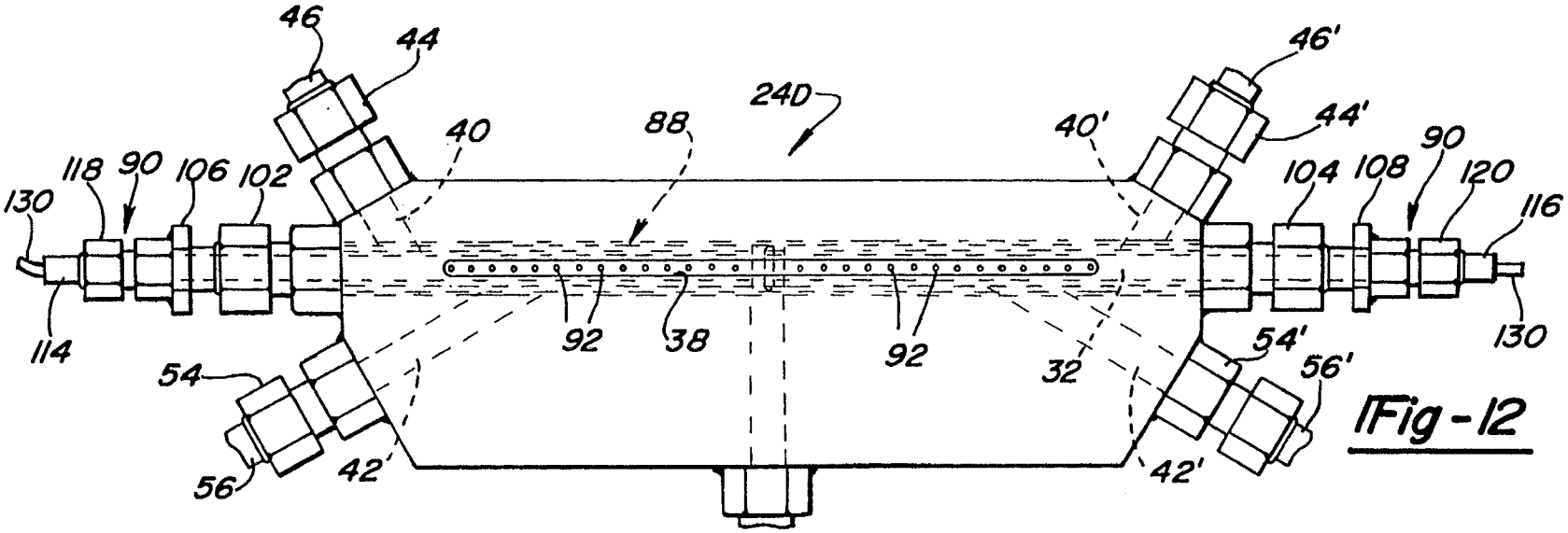
FIG. 12 is an elevational view of another alternative embodiment of the shoe according to the present invention.

Referring to FIG. 12, another alternative preferred embodiment of the shoe of the present invention is shown and indicated generally by the reference designation 24D. In general, shoe 24D can be equipped with any of the above-noted electrically-controlled heating mechanisms 90 and is only modified relative to that disclosed above to include additional inlet and outlet passages 40' and 42', respectively. It is appreciated that the present invention can be formed with multiple inlets and outlets which, for example, include additional inlet passage 40' and outlet passage 42'. Obviously suitable inlet and outlet fittings 44' and 54', respectively, and additional supply and return lines 46' and 56', respectively, would be utilized. Moreover, a center opening 150 is shown which can serve as a single or additional inlet or outlet passage.

Figure 13:
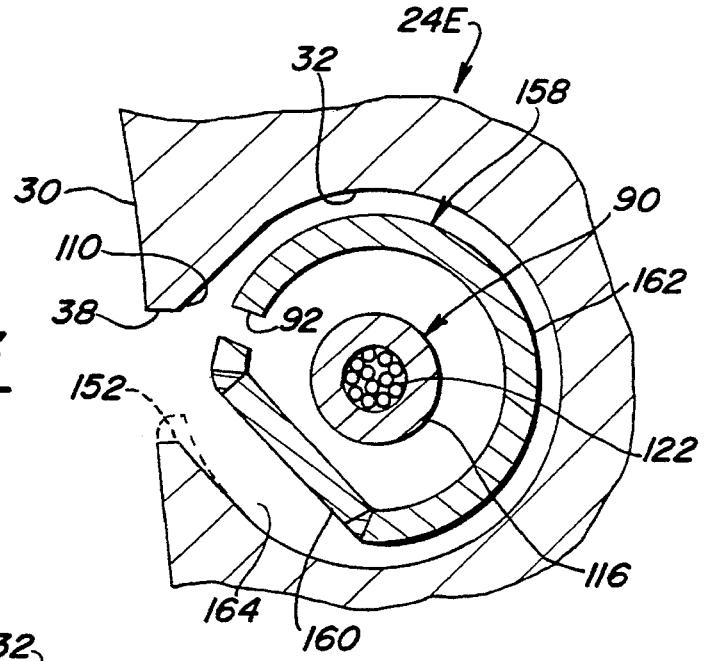
FIG. 13 is a partial sectional view of an alternative embodiment of the distribution tube housed within the improved shoes of the present invention.
Figure 14:
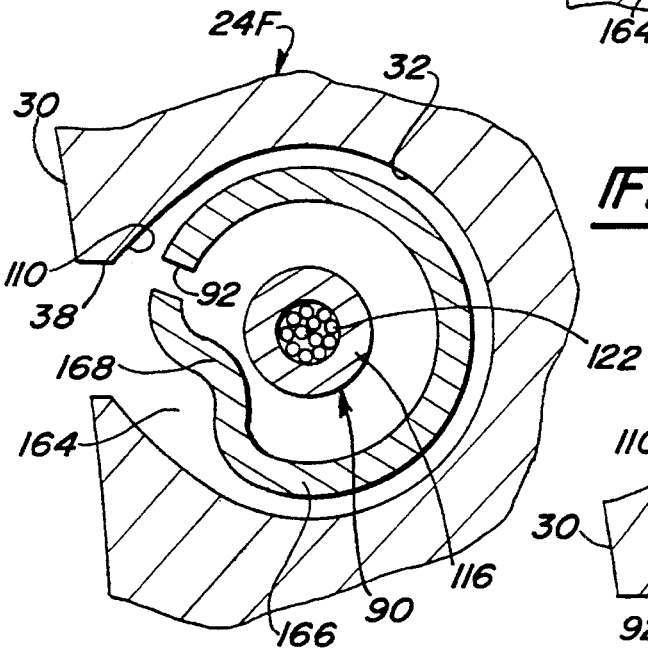
FIG. 14 is a partial sectional view of another distribution tube construction for the improved shoes of the present invention.
Figure 15:
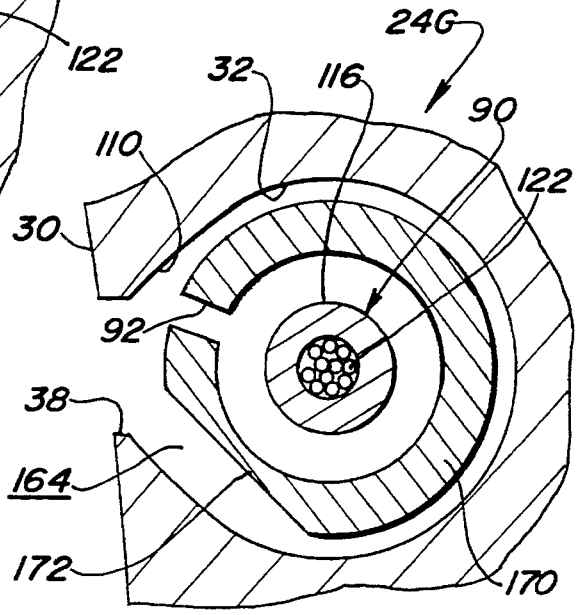
FIG. 15 is a partial sectional view of another alternative construction for the distribution tube.

FIGS. 13 through 15 show alternative constructions for distribution tube 88 which each establish an enlarged entrapment channel leading to outlet passage 42. In general, each alternative construction for distribution tube 88 shown surround a tube-type heating mechanism 90 for purposes of illustration. More particularly, FIG. 13 is a cross-sectional view of another embodiment of the shoe of the present invention, generally indicated by the reference designation 24E. Phantom line 152 indicates the natural accumulation of partially solidified casting material as shoe 24E disperses the molten material onto grid cavity 22 as it moves past shoe 24E. This accumulation of material is under the pressure of material flow and conforms to grid cavity 22, thereby effecting a seal which eliminates the formation of flash on continuous grid strip 60. As shown, a modified distribution tube 158 is disposed within internal passageway 32. A planar segment 160 is welded to a corresponding opening in a cylindrical tube section 162 so as to form an enlarged entrapment cavity 164. This cavity allows increased accessibility of excess molten material to outlet passage 42. FIG. 14 illustrates a shoe 24F having a dimpled distribution tube 166 defining an elongated inwardly-directed rib 168. Finally, FIG. 15 shows a shoe 24G having a distribution tube 170 with a planar surface 172 machined therein for establishing cavity 164.

Figure 16:
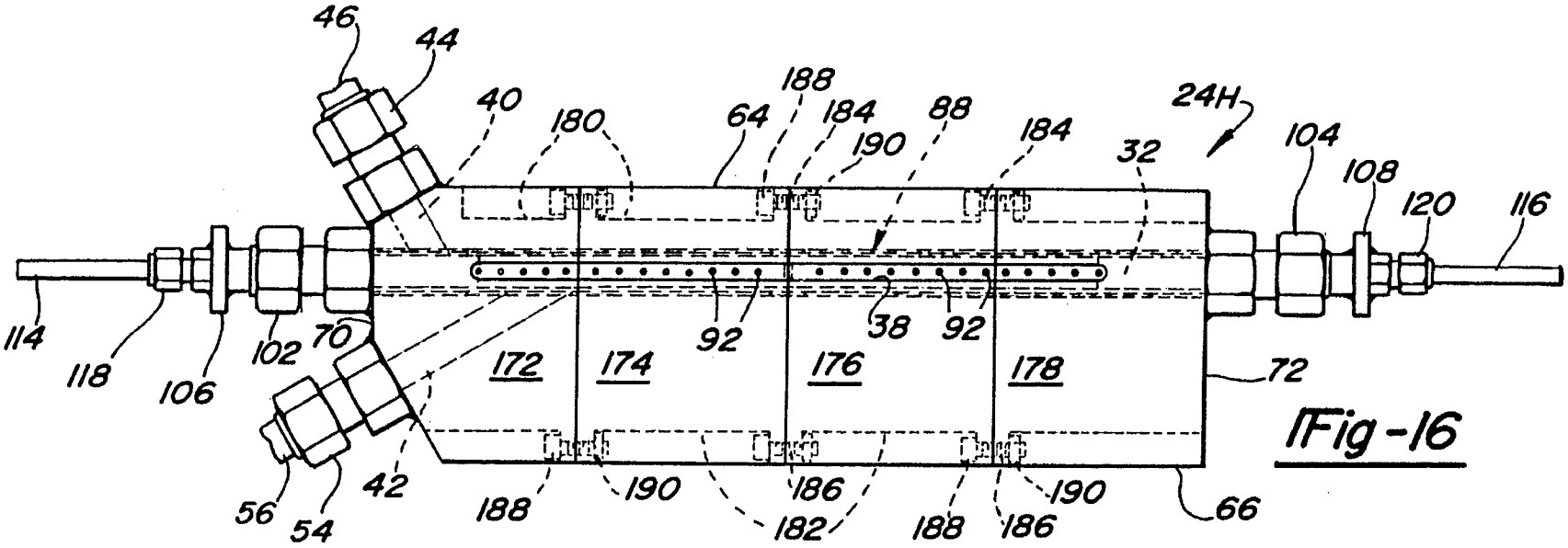
FIG. 16 is an elevational view of a multi-section shoe assembly according to the present invention.
Figure 17:
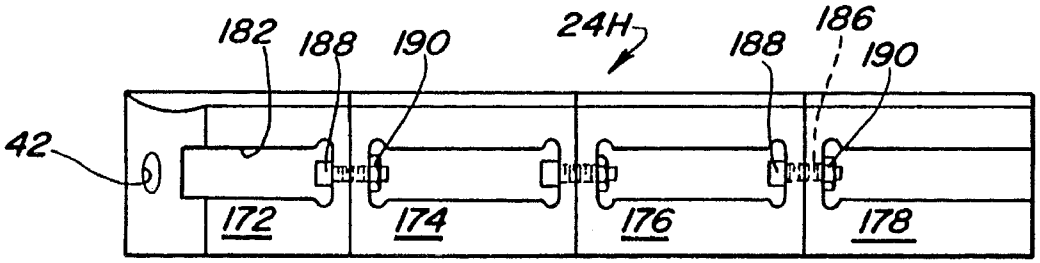
FIG. 17 is a bottom view, with various parts removed for clarity, of the shoe shown in FIG. 16.
Figure 18:
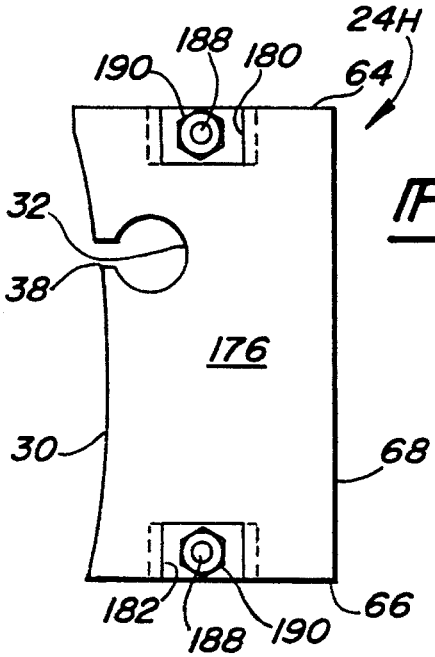
FIG. 18 is an end view of one of the sections shown in FIG. 17.

Due to the capability to cast wider grids 60 via utilization of supplemental heaters installed in passageway 32, the need exists to have shoes of different widths. Accordingly, a desirable feature of the present invention is the use of a "modular" shoe that can be easily assembled from a set of standardized components to fit a particular application. To this end, FIGS. 16 through 18 illustrate a shoe 24H that is a modular assembly of four distinct shoe segments 172, 174, 176 and 178 that are interconnected to define a common internal passageway 32. In general, shoe 24H is shown to be largely identical to shoe 24 of FIG. 3 with the exception that it is made of interconnectable sections. Moreover, the number of sections used as well as the shape and length of available section can be varied to assemble a custom shoe. Recesses such as top recess 180 and bottom recess 182 in each section provide access to threaded holes in each adjacent section, such as top hole 184 and bottom hole 186 which are alignable to similar threaded holes in each adjacent section. The sections are fastened together, for example, by bolt 188 and nuts 190. Due to incorporation of heating mechanism 90 into internal passageway 32, shoe 24H can be of any desired width which, in turn, permits use of wider grid cavities 22 on drum 14. As such, two or more grids may be cast side-by side on a common grid trip 60 for enhanced productivity.

Figure 19:
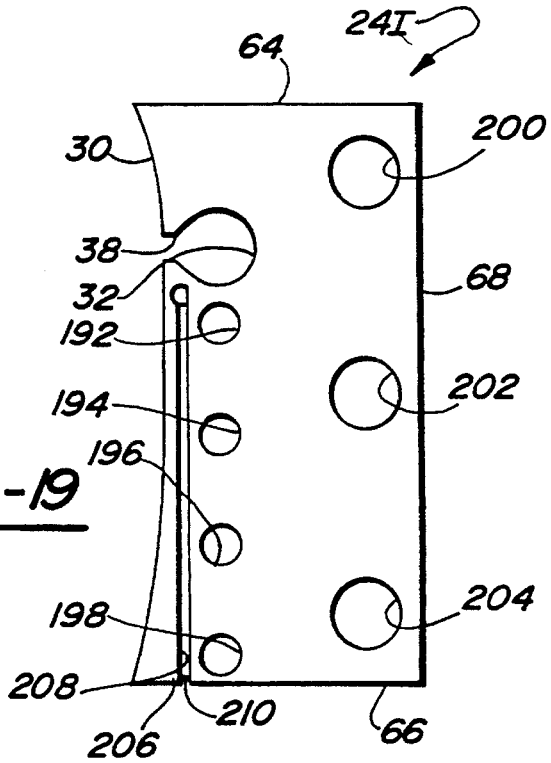
FIG. 19 is a sectional view of yet another alternative embodiment of the shoe according to the present invention.

FIG. 19 is a cross-sectional view of yet another preferred embodiment of the shoe of the present invention, generally indicated by the reference numeral 24I. Shoe 24I comprises internal passageway 32 in which distribution tube 88 and heating mechanism 90 are inserted. Heater holes 192 through 198 have heaters (not shown) inserted therein with individual controls. Likewise, heater holes 200 through 204 have heaters (not shown) inserted therein to control warpage. Shoe 24I includes an elongated skirt 206 defined between outer surface 30 and an elongated slot 208. A ceramic insert 210 is disposed within slot 208. Elongated skirt 206 effectively increases the surface passing beneath shoe 24I, thereby allowing longer contact time between grid cavity 22 and shoe 24I. Increased contact time is desirable when casting lead battery grids with increased cross sectional depths, such as positive battery grids. Ceramic insert 210 is used to insulate skirt 206 and transfer the pressure created by thermal expansion on shoe 24I by heaters in heater holes 192–198 to casting drum 14.

Figure 20:
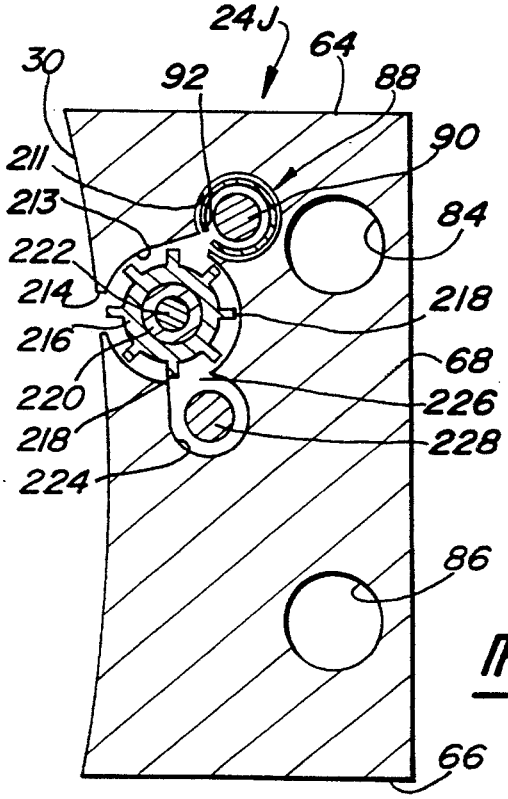
FIG. 20 is a sectional view of another final embodiment of the shoe according to the present invention.

Finally, FIG. 20 is a cross-sectional view of another preferred embodiment of the shoe of the present invention, generally indicated by the reference designation 24J. Shoe 24J comprises an inlet passageway 211 in which distribution tube 88 and heating mechanism 90 are disposed. In addition, a second passageway 213 is formed in shoe 24J that is in communication with inlet passageway 211 via an inlet slot 212. Second internal passageway 213 communicates with outer shoe surface 30 via a discharge slot 214 that is generally similar to the above-noted discharge slot 38. An impeller 216 is disposed for rotation in second passageway 213 and includes a series or radial projections 218. Molten casting material injected into second passageway 213 from distribution tube 88 is forcibly urged against projections 218 which causes impeller 216 to rotate for evenly and gently allowing the molten casting material to fall onto grid cavity 22. Heater holes 84 and 86 are again provided for housing heaters (not shown) to keep shoe 24J hot before the material flow starts. Impeller 216 surrounds an elongated sleeve 220 which, in turn, surrounds a second heating mechanism 222. Molten material enters the second internal passageway 213 through inlet slot 212 upon discharge from distribution tube 88 which has its injector holes 92 aimed toward slot 212. In addition, an outlet passageway 224 is positioned to run parallel to internal passageways 211 and 213. Excess molten material exits internal passageway 213 through outlet slot 226 and is kept molten by third heating mechanism 228. As is readily evident, heating mechanisms 90, 222 and 228 are each electrically-controlled in the manner described above. It should also be appreciated that inlet passageway 211 and outlet passageway 224 can be utilized in any of the preferred embodiments described above. Similarly, for example, impeller 216 could be used in modular sectional shoe 24H and combined with any heating mechanism and/or inlet and outlet construction.

In operation, any one of the various shoes of the present invention can be fixedly mounted such that it is in sliding contact with a rotating casting tool having a desired cavity formed thereon or attached thereto. The shoe acts to disperse molten casting material onto the cavity as well as scrape away excess. The shoe is connected to a molten material source such that the molten material is pumped to continually supply pressurized molten material to the shoe inlet. In use, the heating mechanism(s), thermocouples, shoe heaters, and any desired cooling systems all contribute to producing a shoe which disperses a molten casting material at a designated temperature, being uniform at any desired position, onto a passing mold cavity having any desired width, shape, or pattern.

While the present invention is particularly well-suited for continuous casting of lead battery grids for lead-acid battery applications, it is contemplated that the improved casting apparatus and corresponding method of operation can be used for casting other products. Regardless, the present invention is a significant advancement over the current level of technology in the field of continuous casting of lead battery grids and, as such, is anticipated to promote enhanced production capacity from existing casting machinery while concomitantly increasing the product quality. Whereas particular embodiments of the invention have been described above, for purposes of illustration, it will be evident to those skilled in the art that numerous variations of the details may be made and combined without departing from the invention as defined in the appended claims.

What is claimed is:

1. A continuous casting machine comprising:

a rotatable casting component having a continuous mold cavity formed in a surface thereof;

a shoe having an outer surface overlying said mold cavity, an inlet, an outlet, a passageway extending between said inlet and outlet, a discharge slot extending between said passageway and said outer shoe surface, and a heating mechanism disposed within said passageway;

a source of molten casting material;

a supply line interconnecting said source of molten casting material to said inlet;

a return line interconnecting said outlet to said source of molten casting material;

means for rotating said casting component relative to said shoe for continuously moving said mold cavity past said discharge slot in said shoe surface;

means for directing said molten casting material at a desired pressure and flow rate from said source through said supply line and said inlet to said passageway; and control means for controlling the temperature of said heating mechanism for maintaining said molten casting material flowing through said passageway at a predetermined temperature.

2. The machine of claim 1 wherein said shoe is assembled from a plurality of detachably interconnected sections each having an alignable passageway segment.

3. The machine of claim 1 wherein said heating mechanism is selected from a group comprising electrically-controlled cartridge heaters, tubular heaters, and resistance heater sized for insertion within said passageway and which is connected to a source of electrical power.

4. The machine of claim 1 wherein said heating mechanism is coaxially aligned within said passageway for contact with said molten casting material flowing through said passageway, and wherein said heating mechanism is an electrical heating device and said control means is operable for regulating the magnitude of electrical power delivered to said heating device from a remote electrical power supply for maintaining the temperature of said molten casting material at said predetermined temperature.

5. The machine of claim 4 further comprising a distribution tube supported within said passageway and surrounding said heating device, said distribution tube having inlet means for permitting fluid communication with said inlet in said shoe, a series of injector holes alignable with said discharge slot, and means for adjusting the angular relationship of said distribution tube relative to said shoe for causing a corresponding change in the annular alignment of said injector holes with respect to said discharge slot.

6. In a continuous casting machine of the type having a rotary mold cavity movable relative to a shoe in fluid communication with a source of molten casting material, said shoe comprising a main body defining an internal passageway and a discharge slot leading from said internal passageway to an outer surface of said shoe, an inlet and an outlet connecting said internal passage to the source of molten casting material, and heating means positioned within said internal passageway for heating the molten casting material flowing through said passageway prior to discharge from said discharge slot.

7. The shoe of claim 6 wherein said shoe is assembled from a plurality of detachably interconnected sections each having an alignable passageway segment.

8. The shoe of claim 6 wherein said heating means is selected from a group comprising electrically-controlled cartridge heaters, tubular heaters, and resistance heater sized for insertion within said passageway and which is connected to a source of electrical power.

9. The shoe of claim 8 further comprising control means for regulating the power delivered to said electrically-controlled heating means for maintaining the molten casting material in said passageway at a predetermined temperature.

10. The shoe of claim 6 further comprising a distribution tube supported within said passageway and surrounding said heating means, said distribution tube having inlet means for permitting fluid communication with said inlet in said shoe, a series of injector holes alignable with said discharge slot, and means for adjusting the angular relationship of said distribution tube relative to said shoe for causing a corresponding change in the annular alignment of said injector holes with respect to said discharge slot.

11. The shoe of claim 10 wherein said distribution tube includes first and second tube sections extending toward each other from opposite sides of said main body and which are aligned and supported by aligning sleeves retained within said internal passageway.

12. The shoe of claim 10 wherein said distribution tube has a connecting hole which communicates with said inlet, said distribution tube being noncircular such that an area within said internal passageway surrounding said distribution tube is enlarged for permitting excess molten casting material to accumulate prior to exiting out of said outlet.

13. In a continuous casting machine of the type having a rotary mold cavity movable relative to a shoe in fluid communication with a source of molten casting material, said shoe comprising a main body formed from a series of sections that are fastened together and which define a common internal passageway and a common discharge slot leading from said passageway to an outer surface of said main body, at least one of said sections including an inlet and an outlet connecting said internal passage to said source of molten casting material, and heating means positioned within said internal passageway for heating the molten casting material flowing through said passageway prior to discharge from said discharge slot.

14. The shoe of claim 13 wherein said shoe has an elongated slot forming a flexible skirt portion adjacent to said outer surface, and means for urging said skirt portion into contact with the rotary mold cavity.

15. The shoe of claim 13 wherein said heating means is selected from a group comprising electrically-controlled cartridge heaters, tubular heaters, and resistance heater sized for insertion within said passageway and which is connected to a source of electrical power.

16. The shoe of claim 15 further comprising control means for regulating the power delivered to said electrically-controlled heating means for maintaining the molten casting material in said passageway at a predetermined temperature.

17. In a continuous casting machine of the type having a rotary mold cavity movable relative to a shoe in fluid communication with a source of molten casting material, said shoe comprising:

a main body defining an inlet passageway, a second passageway in communication with said inlet passageway, an outlet passageway in communication with said second passageway, a discharge slot leading from said second passageway to an outer surface of said shoe, an inlet connecting said inlet passageway to the source of molten casting material, and an outlet connecting said outlet passageway to the source of molten casting material;

heating means positioned within said inlet passageway for heating the molten casting material flowing therethrough; and an impeller supported for rotation in said second passageway, said impeller being rotatably driven by the casting material entering said second passageway from said inlet passageway for discharging the material through said discharge slot.

18. The machine of claim 17 wherein said shoe is assembled from a plurality of detachably interconnected sections each having alignable passageway segments.

19. The machine of claim 17 wherein said heating means is selected from a group comprising electrically-controlled cartridge heaters, tubular heaters, and resistance heater sized for insertion within said inlet passageway and connected to a source of electrical power.

20. The machine of claim 19 further comprising control means for regulating the power delivered to said electrically-controlled heating means for maintaining the molten casting material in said inlet passageway at a predetermined temperature.

21. The machine of claim 20 further comprising a distribution tube supported within said inlet passageway and surrounding said heating means, said distribution tube having inlet means for permitting fluid communication with said inlet in said shoe, a series of injector holes alignable with an inlet slot between said inlet passageway and said second passageway, and means for adjusting the angular relationship of said distribution tube relative to said main body of said shoe for causing a corresponding change in the angular alignment of said injector holes with respect to said inlet slot.

22. The machine of claim 20 further comprising a second electrically-controlled heating means inserted in said second passageway, said control means further operable to regulate said second heating means.

23. The machine of claim 22 further comprising a third electrically-controlled heating means inserted in said outlet passageway and which is controlled by said control means for regulating the temperature of molten material in said outlet passageway.

24. A method of continuously casting a strip upon rotation of a casting mold having a continuous patterned cavity formed therein, said method comprising the steps of:

directing molten casting material at an elevated temperature from a material source to successive segments of the patterned cavity on the rotating casting mold through an inlet, an internal passageway and a discharge slot in a fixed shoe having an outer surface conforming to and positioned against the patterned cavity on the rotating casting mold in close sliding engagement therewith;

heating the molten material flowing through the internal passageway for maintaining the molten material at said elevated temperature; and causing excess molten material to flow back to the material supply through an outlet in the shoe;

wherein said step of heating the molten casting material comprises positioning a heating mechanism within said internal passageway.

25. The method of claim 24 wherein said heating mechanism is selected from a group comprising electrically-controlled cartridge heaters, tubular heaters, and resistance heaters.

26. The method of claim 24 further including the step of directing the molten material to the patterned cavity on the casting mold by installing a distribution tube in said internal passageway and which surrounds said heating mechanism, said distribution tube defining a series of injector holes aligned with said discharge slot and an inlet orifice communicating with said inlet.

* * * * *

UNITED STATES PATENT AND TRADEMARK OFFICE

CERTIFICATE OF CORRECTION

PATENT NO. : 5,497,822

DATED : March 12, 1996

INVENTOR(S) : Raymond L. Schenk

It is certified that error appears in the above-indentified patent and that said Letters Patent is hereby corrected as shown below:

ON THE TITLE PAGE under "Foreign Patent Documents" delete "0467015A2 1/1992 European Pat. Off."

ON THE TITLE PAGE under "Foreign Patent Documents" delete "0485996A2 5/1992 European Pat. Off."

Column 4, line 60 "," should be --.--

Column 6, line 53 delete "-"

Column 8, line 40 "or' should be --of--

Signed and Sealed this

First Day of October, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,497,822
DATED : March 12, 1996
INVENTOR(S) : Raymond L. Schenk

It is certified that error appears in the above-indentified patent and that said Letters Patent is hereby corrected as shown below:

On the title page: Item [73] Assignee: should read
-- Venture Enterprises, Incorporated --.

Signed and Sealed this
Twelfth Day of November, 1996

*Attest:*

Bruce Lehman

BRUCE LEHMAN

*Attesting Officer*

*Commissioner of Patents and Trademarks*